US010065089B2

(12) United States Patent
Park et al.

(10) Patent No.: US 10,065,089 B2
(45) **Date of Patent: *Sep. 4, 2018**

(54) GOLF CLUB HEAD

(71) Applicant: DUNLOP SPORTS CO. LTD., Kobe-shi, Hyogo (JP)

(72) Inventors: Sharon J. Park, Irvine, CA (US); Douglas E. Roberts, Carlsbad, CA (US); Andrew P. Chick, Huntington Beach, CA (US)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/481,881

(22) Filed: Apr. 7, 2017

(65) Prior Publication Data

US 2017/0209754 A1 Jul. 27, 2017

Related U.S. Application Data

(63) Continuation of application No. 14/857,001, filed on Sep. 17, 2015, now Pat. No. 9,643,066, which is a (Continued)

(51) Int. Cl.
*A63B 53/04* (2015.01)
*A63B 53/06* (2015.01)
(Continued)

(52) U.S. Cl.
CPC ..... *A63B 53/0475* (2013.01); *A63B 60/54* (2015.10); *A63B 2053/0416* (2013.01); (Continued)

(58) Field of Classification Search
CPC ..... A63B 53/0475; A63B 60/54; A63B 2060/002; A63B 2053/0416; (Continued)

(56) References Cited

U.S. PATENT DOCUMENTS 572,436 A 12/1896 Mills
873,423 A 12/1907 Govan
(Continued)

FOREIGN PATENT DOCUMENTS

GB 2 280 380 A 2/1995

OTHER PUBLICATIONS

Sep. 2, 2016 Office Action Issued in U.S. Appl. No. 14/857,001.

*Primary Examiner* — Sebastiano Passaniti
(74) *Attorney, Agent, or Firm* — Oliff PLC

(57) ABSTRACT

An iron-type golf club head includes a striking face; a base surface opposite the striking face; and a perimeter weighting element surrounding the base surface and including a top-line portion, a sole portion, a heel portion, and a toe portion. A first auxiliary cavity is delimited by the perimeter weighting element and a first perimeter wall, the first perimeter wall coupled to the sole portion and to the heel portion of the perimeter weighting element. A second auxiliary cavity is delimited by the perimeter weighting element and a second perimeter wall, the second perimeter wall coupled to the sole portion and to the toe portion of the perimeter weighting element. A central cavity is at least partially delimited by the base surface, the perimeter weighting element, the first perimeter wall, and the second perimeter wall, and an insert is within the central cavity.

17 Claims, 12 Drawing Sheets

Related U.S. Application Data continuation of application No. 14/105,991, filed on Dec. 13, 2013, now Pat. No. 9,162,119, which is a continuation of application No. 13/728,036, filed on Dec. 27, 2012, now Pat. No. 8,632,421, which is a continuation of application No. 13/464,100, filed on May 4, 2012, now Pat. No. 8,366,567, which is a continuation of application No. 12/837,806, filed on Jul. 16, 2010, now Pat. No. 8,192,301, which is a continuation of application No. 12/071,132, filed on Feb. 15, 2008, now Pat. No. 7,789,771.

(51) Int. Cl.
*A63B 60/54* (2015.01)
*A63B 60/00* (2015.01)

(52) U.S. Cl.
CPC ..... *A63B 2053/0425* (2013.01); *A63B 2053/0429* (2013.01); *A63B 2053/0433* (2013.01); *A63B 2060/002* (2015.10)

(58) Field of Classification Search
CPC .... A63B 2053/0429; A63B 2053/0433; A63B 2053/0425
USPC ..... 473/324–350, 287–292
See application file for complete search history.

(56) References Cited

U.S. PATENT DOCUMENTS 1,680,881 A 8/1928 Heeter et al.
2,517,245 A 8/1950 Scott
2,838,312 A 6/1958 Drake
2,846,228 A 8/1958 Reach
3,814,437 A * 6/1974 Winquist ..... A63B 53/04 473/324
3,847,399 A 11/1974 Raymont
4,121,832 A 10/1978 Ebbing
4,826,172 A * 5/1989 Antonious ..... A63B 53/04 473/242
4,883,274 A 11/1989 Hsien
4,919,430 A 4/1990 Antonious
4,928,972 A 5/1990 Nakanishi et al.
4,938,470 A 7/1990 Antonious
4,964,640 A 10/1990 Nakanishi et al.
5,014,993 A * 5/1991 Antonious ..... A63B 53/04 473/350
5,082,278 A 1/1992 Hsien
5,104,457 A 4/1992 Viljoen et al.
5,316,298 A 5/1994 Hutin et al.
5,377,985 A 1/1995 Ohnishi
5,395,113 A 3/1995 Antonious
5,445,382 A 8/1995 Pearce et al.
5,447,307 A * 9/1995 Antonious ..... A63B 53/02 473/350
D366,082 S 1/1996 Dekura
5,544,885 A 8/1996 Besnard et al.
5,564,705 A 10/1996 Kobayashi et al.
5,586,947 A 12/1996 Hutin
5,643,112 A 7/1997 Besnard et al.
5,649,872 A 7/1997 Antonious
5,697,855 A 12/1997 Aizawa
5,833,551 A 11/1998 Vincent et al.
5,971,868 A 10/1999 Kosmatka
6,001,032 A 12/1999 Onuki et al.
6,015,354 A 1/2000 Ahn et al.
6,056,649 A 5/2000 Imai
6,059,669 A 5/2000 Pearce
6,077,173 A 6/2000 Stites
6,080,069 A 6/2000 Long
6,206,790 B1 3/2001 Kubica et al.
6,267,691 B1 7/2001 Dammen
6,280,348 B1 8/2001 Stites
6,290,609 B1 9/2001 Takeda
6,309,311 B1 10/2001 Lu
6,450,897 B2 9/2002 Stites et al.
6,454,665 B2 9/2002 Antonious
D469,833 S 2/2003 Roberts et al.
6,592,469 B2 7/2003 Gilbert
6,595,870 B2 7/2003 Stites et al.
6,688,989 B2 2/2004 Best
D492,378 S 6/2004 Roberts et al.
6,743,114 B2 6/2004 Best
6,743,117 B2 6/2004 Gilbert
D496,704 S 9/2004 Roberts et al.
D498,808 S 11/2004 Roberts et al.
D498,809 S 11/2004 Roberts et al.
D499,160 S 11/2004 Wolfe et al.
6,832,962 B2 12/2004 Stites et al.
6,835,144 B2 12/2004 Best
D500,542 S 1/2005 Roberts et al.
6,849,005 B2 2/2005 Rife
6,855,066 B2 2/2005 Best
D505,172 S 5/2005 Roberts et al.
6,896,627 B2 5/2005 Hou
6,902,495 B2 6/2005 Pergande et al.
6,918,840 B2 7/2005 Stites et al.
6,921,344 B2 7/2005 Gilbert et al.
D508,545 S 8/2005 Roberts et al.
6,923,732 B2 8/2005 Stites et al.
6,932,717 B2 8/2005 Hou et al.
7,128,660 B2 10/2006 Gillig
7,153,222 B2 12/2006 Gilbert et al.
7,192,364 B2 3/2007 Long
7,201,669 B2 4/2007 Stites et al.
7,250,008 B2 7/2007 Dewanjee et al.
7,387,579 B2 6/2008 Lin et al.
7,393,287 B2 7/2008 Huang
7,476,162 B2 1/2009 Stites et al.
7,789,771 B2 9/2010 Park et al.
7,935,000 B2 * 5/2011 Stites ..... A63B 53/047 473/291
8,192,301 B2 6/2012 Park et al.
8,246,487 B1 8/2012 Cackett et al.
8,366,567 B2 2/2013 Park et al.
8,632,421 B2 1/2014 Park et al.
9,162,119 B2 10/2015 Park et al.
9,643,066 B2 * 5/2017 Park ..... A63B 53/047
2001/0014628 A1 8/2001 Erickson et al.
2004/0132543 A1 7/2004 Caldwell
2004/0166959 A1 8/2004 Chen
2005/0009632 A1 1/2005 Schweigert et al.
2005/0119066 A1 6/2005 Stites et al.
2005/0148407 A1 7/2005 Gilbert et al.
2005/0266931 A1 12/2005 Hou et al.
2005/0277485 A1 12/2005 Hou et al.
2006/0030425 A1 2/2006 Sukman
2006/0194641 A1 8/2006 Best
2006/0223652 A1 10/2006 Hou
2006/0258480 A1 11/2006 Hou et al.
2007/0042837 A1 2/2007 Bamber
2007/0178988 A1 8/2007 Tavares et al.
2009/0029791 A1 1/2009 Solheim
2010/0178999 A1 7/2010 Nicolette et al.
2010/0304887 A1 12/2010 Bennett et al.

* cited by examiner

GOLF CLUB HEAD

RELATED U.S. APPLICATION DATA

This is a Continuation Application of application Ser. No. 14/857,001 filed on Sep. 17, 2015, which in turn is a Continuation Application of application Ser. No. 14/105,991 filed on Dec. 13, 2013, which is in turn a Continuation of application Ser. No. 13/728,036 filed on Dec. 27, 2012, which in turn is a Continuation of application Ser. No. 13/464,100 filed on May 4, 2012, which is a Continuation of application Ser. No. 12/837,806 filed Jul. 16, 2010, which is a Continuation of application Ser. No. 12/071,132 filed Feb. 15, 2008 (now U.S. Pat. No. 7,789,771). The prior applications, including the specifications, drawings and abstracts are incorporated herein by reference in their entirety.

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

Iron-type golf club heads may generally be classified into "blade" and "perimeter-weighted" categories. Perimeter-weighted iron-type golf club heads may have a substantial concentration of mass distributed behind the striking surface in the form of at least one peripheral wall, sometimes called the perimeter-weighting element. A perimeter-weighted iron-type golf club head may also be referred to as a "cavity-back" iron head, or simply a "cavity-back", because the perimeter-weighting element thereof generally delimits a cavity in the rear portion of the club head opposite the striking face.

Perimeter-weighted irons are typically more "forgiving" than those of the blade type because the elevated moment of inertia generally associated with perimeter-weighted designs results in decreased head rotation when a ball is mishit, or struck away from the point of orthogonal projection of the club head's center of gravity onto the striking surface of the iron. Diminished rotation of the club head at impact may increase the accuracy and distance of such mishit shots. Thus, perimeter-weighted irons may substantially benefit less skilled golfers, who are likely to mishit the ball.

Various improvements for cavity-back iron heads, such as localized mass concentrations along the perimeter-weighting element, have been proposed. For example, it is well known that lowering the club head's center of gravity generally increases ball-launch angle at impact, thus facilitating shots from a variety of lies. Accordingly, sole-weighted cavity-back iron heads help improve ball-launch conditions.

In addition to mass-distribution improvements, a variety of vibration-attenuation technologies have been proposed for cavity-back irons. Some examples comprise a constrained-layer damper positioned behind the striking face within the rear cavity. Others include a resilient insert centrally disposed in the rear cavity. Typically, such inserts are made from materials having vibration-damping characteristics and low density.

However, club heads comprising a resilient insert located in the rear cavity may lack sufficient tactile feedback for a player to distinguish a well-made shot from a mediocre one. In addition, even though club heads fitted with constrained-layer dampers provide abatement of undesirable dynamic-excitation-response modes for a range of mishit shots, unfavorable dynamic-excitation-response modes associated with, e.g., extreme heel and toe mishits for such club heads remain problematic.

SUMMARY

The present invention, in one or more aspects thereof, may advantageously comprise a golf club head having improved forgiveness on mishit shots, enhanced tactile feedback, increased structural integrity, and reduced hook/slice tendencies.

In one example, a golf club head according to one or more aspects of the present invention may include a base surface located rearward of the striking surface and an insert associated with the base surface. The insert includes at least two contact elements and a bridge member disposed therebetween. At least a portion of each contact element of the insert may be associated with the base surface of the club head, whereas the bridge member of the insert may be dissociated from the base surface.

In another example, a golf club head according to one or more aspects of the present invention may include an insert and a main cavity comprising a first auxiliary cavity and a second auxiliary cavity. One portion of the insert may be disposed in the first auxiliary cavity and another portion of the insert may be disposed in the second auxiliary cavity.

In another example, a golf club head according to one or more aspects of the present invention may include a rear surface and a main cavity formed in the rear surface. The main cavity may comprise a base surface having an organic coating disposed on less than about 50% of the base surface. Additionally, an insert may be coupled to the base surface by an adhesive.

In yet another example, a golf club head according to one or more aspects of the present invention may be manufactured by providing a semi-finished club head with a rear surface comprising a main cavity including a base surface; placing a masking material on at least about 50% of the base surface; applying an organic to at least a portion of the base surface devoid of the masking material; removing the masking material; and bonding an insert to at least a portion of the base surface.

These and other features and advantages of the golf club head according to the invention in its various aspects as provided by one or more of the examples described in detail below will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

Exemplary implementations of the present invention will now be described with reference to the accompanying drawings, wherein.

DETAILED DESCRIPTION

Figure 1A:
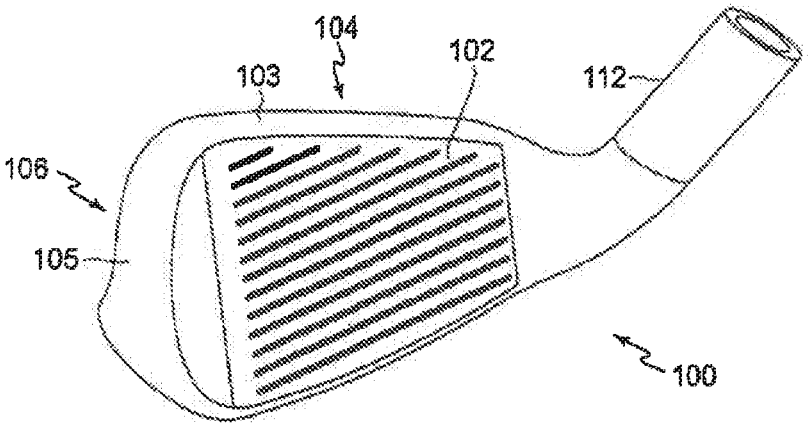
FIG. 1*a* is a front perspective view of an exemplary golf club head in accordance with one or more aspects of the present invention.
Figure 1B:
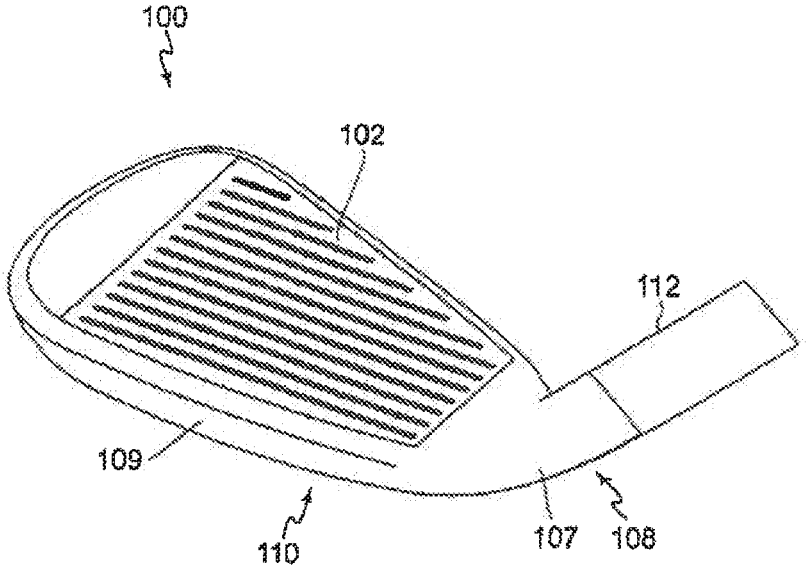
FIG. 1*b* is another front perspective view of the golf club head of FIG. 1*a*.

Referring to FIGS. 1*a* and 1*b*, an iron-type golf club head 100, according to one or more aspects of the present invention, may generally comprise a front surface 102 that may be substantially planar over a majority of its area and delimited by a top line 104, a toe 106, a heel 108, and a sole 110. The heel 108 may generally comprise a heel surface 107 and the sole 110 may comprise a sole surface 109. The head 100 may further comprise a hosel 112 for attaching a shaft (not shown) to the head. Referring again to FIG. 1*a*, the top line 104 may comprise a top line surface 103 and the toe 106 may comprise a toe surface 105.

Figure 1C:
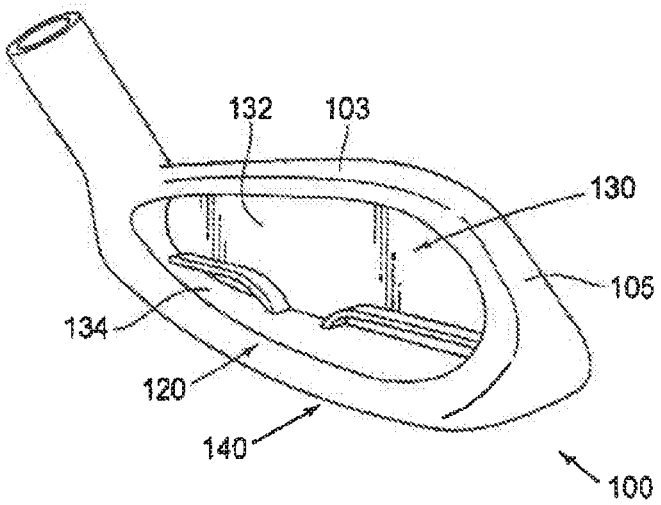
FIG. 1*c* is a rear perspective view of the golf club head of FIG. 1*a*.
Figure 1D:
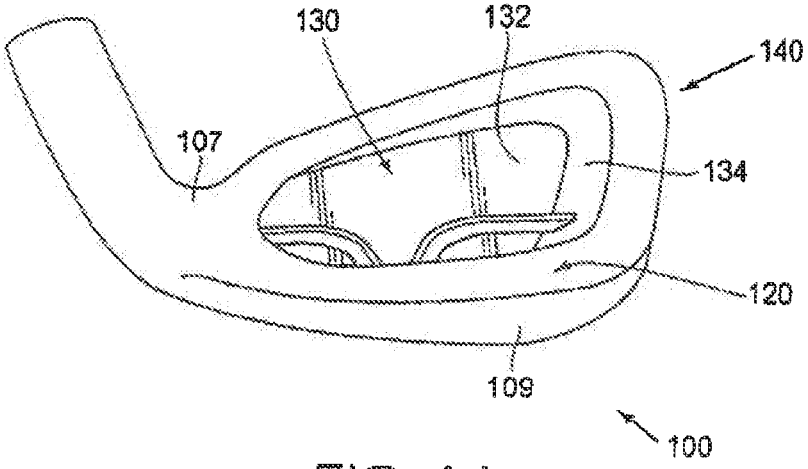
FIG. 1*d* is another rear perspective view of the golf club head of FIG. 1*a*.

With reference to FIGS. 1*c* and 1*d*, the head 100 may further comprise a rear surface 120 having a main cavity 130. The rear surface 120 may be bounded at its outer extent by the top line surface 103, the toe surface 105, the heel surface 107, and the sole surface 109. The main cavity 130 includes a base surface 132, surrounded, at least in part, by a perimeter surface 134, extending from the base surface 132 to the rear surface 120. The club head 100 may also comprise a perimeter weighting element 140, defined by the volume of material bounded by the perimeter surface 134, the rear surface 120, the top line surface 103, the toe surface 105, the heel surface 107, and the sole surface 109.

Figure 1E:
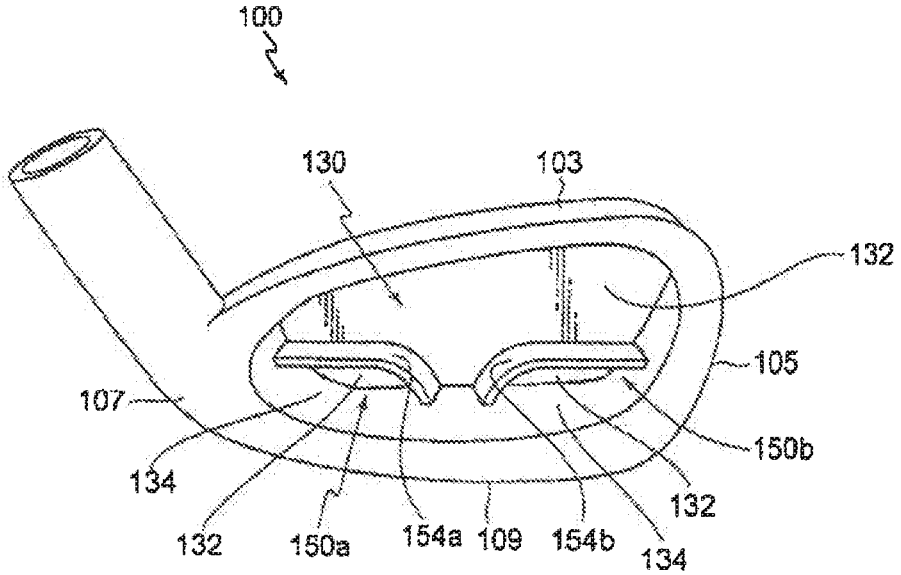
FIG. 1*e* is another rear perspective view of the golf club head of FIG. 1*a*.

With reference to FIG. 1*e*, the main cavity 130 of the exemplary golf club head 100 may further comprise at least one auxiliary cavity, e.g., auxiliary cavities 150*a* and 150*b*. Each auxiliary cavity may be delimited by a perimeter wall, e.g., the perimeter walls 154*a* and 154*b*, a perimeter surface 134, and a base surface 132. While the auxiliary cavities are shown generally opposite the sole surface 109, these cavities may be located opposite any portion of the top line surface 103, the toe surface 105, the heel surface 107, and/or the sole surface 109.

Figure 2:
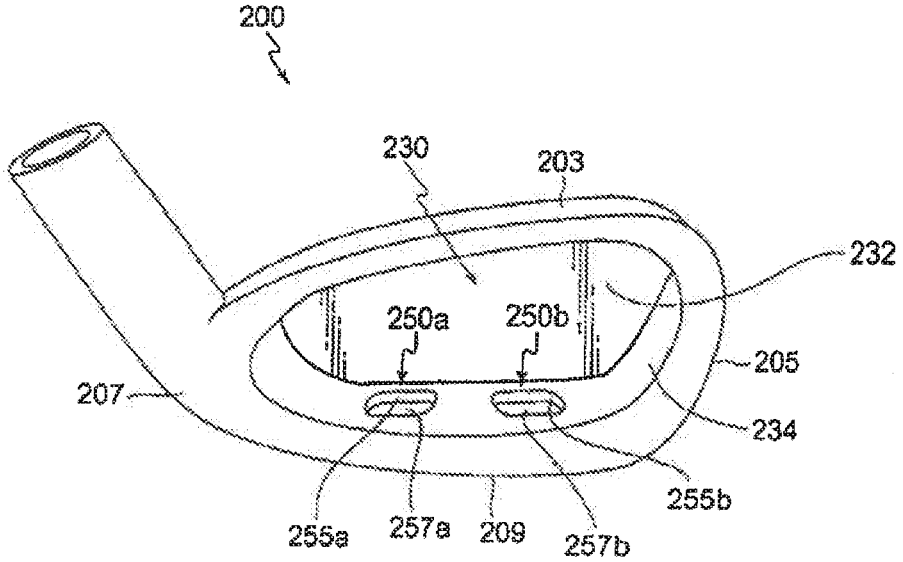
FIG. 2 is a rear perspective view of an exemplary golf club head in accordance with one or more aspects of the present invention.
Figure 3:
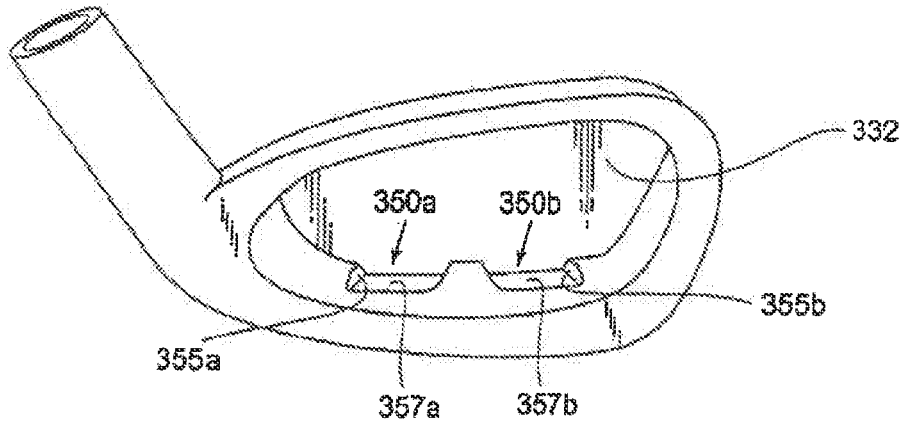
FIG. 3 is a rear perspective view of an exemplary golf club head in accordance with one or more aspects of the present invention.

As shown in FIG. 2, an exemplary golf club head 200, according to one or more aspects of the present invention, may comprise a main cavity 230 bounded by a base surface 232 and a perimeter surface 234. At least one auxiliary cavity, e.g., auxiliary cavities 250*a* and 250*b*, may be disposed in the perimeter surface 234. The auxiliary cavities 250*a* and 250*b* may be bounded by side walls 255*a* and 255*b*, respectively, and bottom surfaces 257*a* and 257*b*, respectively. Although the cavities are shown to be disposed generally opposite a sole surface 209, the cavities may be located opposite any portion of a top line surface 203, a toe surface 205, a heel surface 207, and/or the sole surface 209. As illustrated in FIG. 3, auxiliary cavities, e.g., cavities 350*a* and 350*b*, may be bounded by side walls 355*a* and 355*b*, respectively, bottom surfaces 357*a* and 357*b*, respectively, and portions of a base surface 332.

Figure 4:
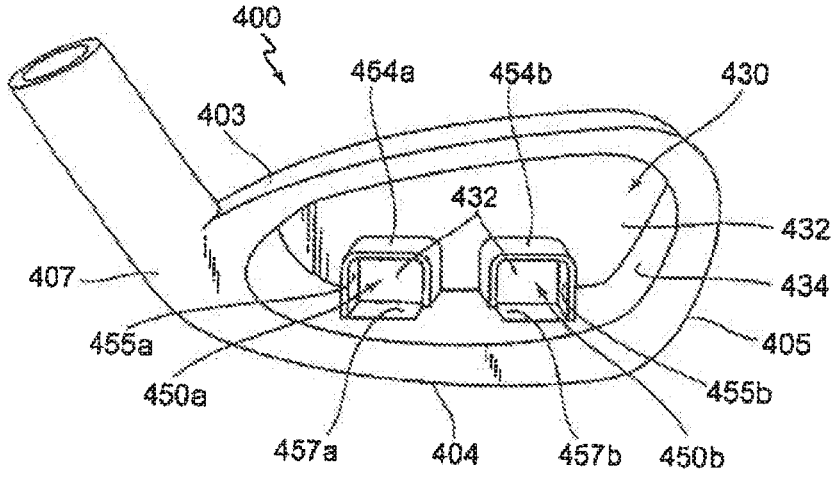
FIG. 4 is a rear perspective view of an exemplary golf club head in accordance with one or more aspects of the present invention.

Referring to FIG. 4, an exemplary golf club head 400, according to one or more aspects of the present invention, may comprise a main cavity 430 bounded by a base surface 432 and a perimeter surface 434. At least one auxiliary cavity, e.g., auxiliary cavities 450*a* and 450*b*, may be bounded by side walls 455*a* and 455*b*, respectively, perimeter walls 454*a* and 454*b*, respectively, bottom surfaces 457*a* and 457*b*, respectively, and portions of a base surface 432. Although the auxiliary cavities are shown to be disposed generally opposite a sole surface 409, the cavities may be located opposite any portion of a top line surface 403, a toe surface 405, a heel surface 407, and/or the sole surface 409.

Figure 5:
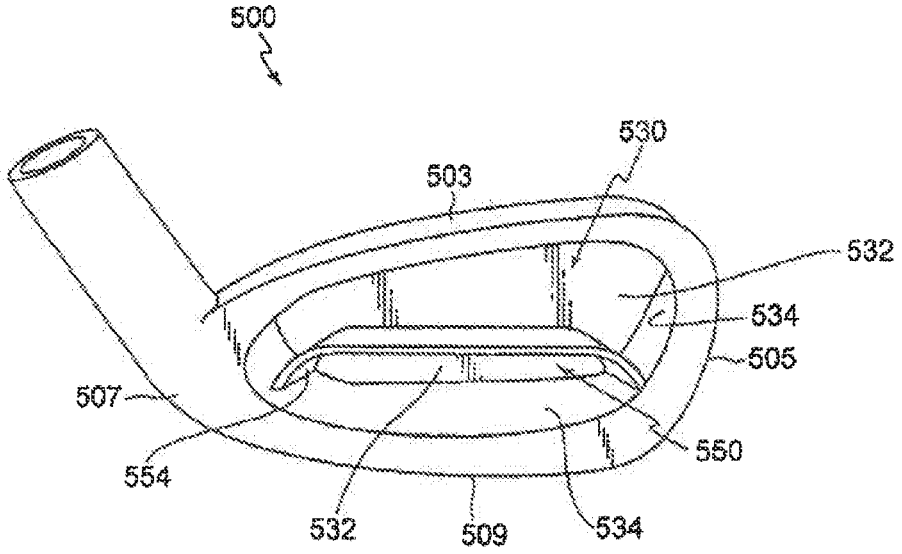
FIG. 5 is a rear perspective view of an exemplary golf club head in accordance with one or more aspects of the present invention.

With reference to FIG. 5, an exemplary golf club head 500, according to one or more aspects of the present invention, may comprise a main cavity 530 having a single auxiliary cavity 550. The cavity 550 may be bounded by a perimeter wall 554, a perimeter surface 534, and a base surface 532. Although the auxiliary cavity is shown to be disposed generally opposite a sole surface 509, the cavity may be located opposite any portion of a top line surface 503, a toe surface 505, a heel surface 507, and/or the sole surface 509.

Figure 6:
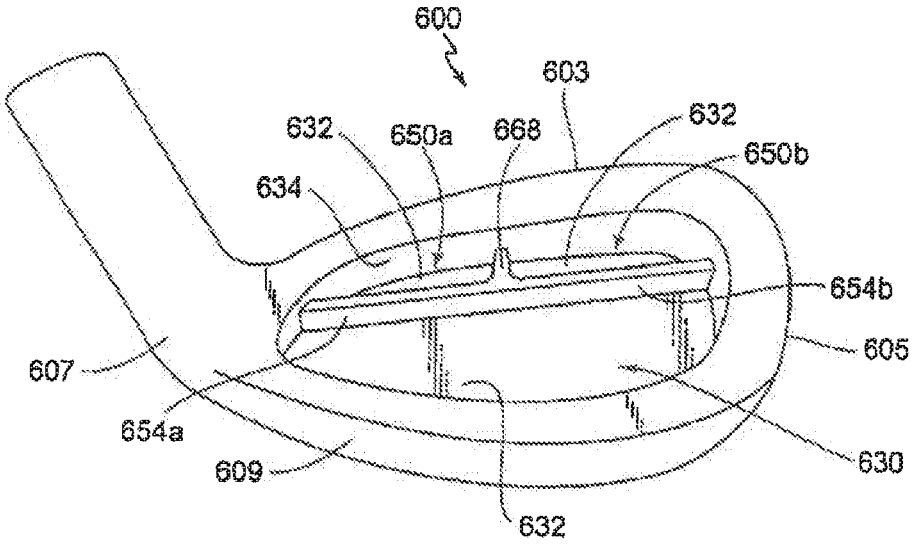
FIG. 6 is a rear perspective view of an exemplary golf club head in accordance with one or more aspects of the present invention.

As shown in FIG. 6, a golf club head 600, according to one or more aspects of the present invention, may comprise a main cavity 630 having at least one auxiliary cavity, e.g., auxiliary cavities 650*a* and 650*b*. The cavities 650*a* and 650*b* may be bounded by a perimeter surface 634, portions of a base surface 632, and perimeter walls 654*a* and 654*b*, respectively, having a shared portion 668. Although the auxiliary cavities are shown to be disposed generally opposite a top line surface 603, the cavities may be located opposite any portion of a sole surface 609, a toe surface 605, a heel surface 607, and/or the top line surface 603.

Figure 7A:
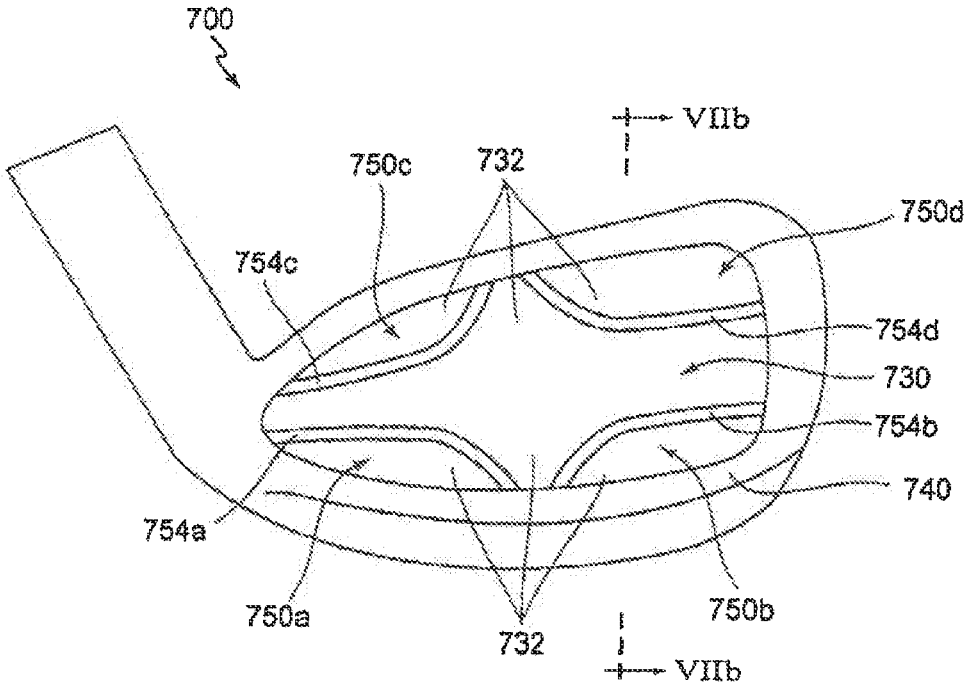
FIG. 7*a* is a rear elevational view of an exemplary golf club head in accordance with one or more aspects of the present invention.
Figure 7B:
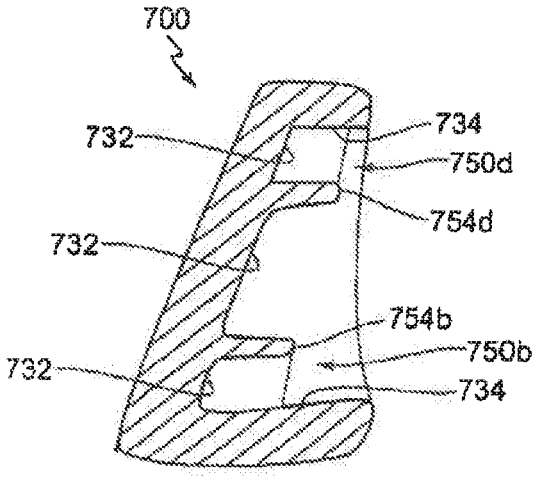
FIG. 7*b* is a cross-sectional view taken along the lines VIIb-VIIb of FIG. 7*a*.

As shown in FIGS. 7*a* and 7*b*, a golf club head 700, according to one or more aspects of the present invention, may comprise a main cavity 730 having three or more auxiliary cavities, e.g., auxiliary cavities 750*a-d*. Each auxiliary cavity may be bounded by a base surface 732, a perimeter surface 734, and a perimeter wall, e.g., one of auxiliary perimeter walls 754*a-d*. The reinforcement of the base surface 732 provided by the perimeter walls of the auxiliary cavities may deliver improved dynamic-excitation response of the club head at ball impact. As described in detail below, additional elements may be incorporated into the club head to further enhance the dynamic-excitation response thereof.

Figure 8:
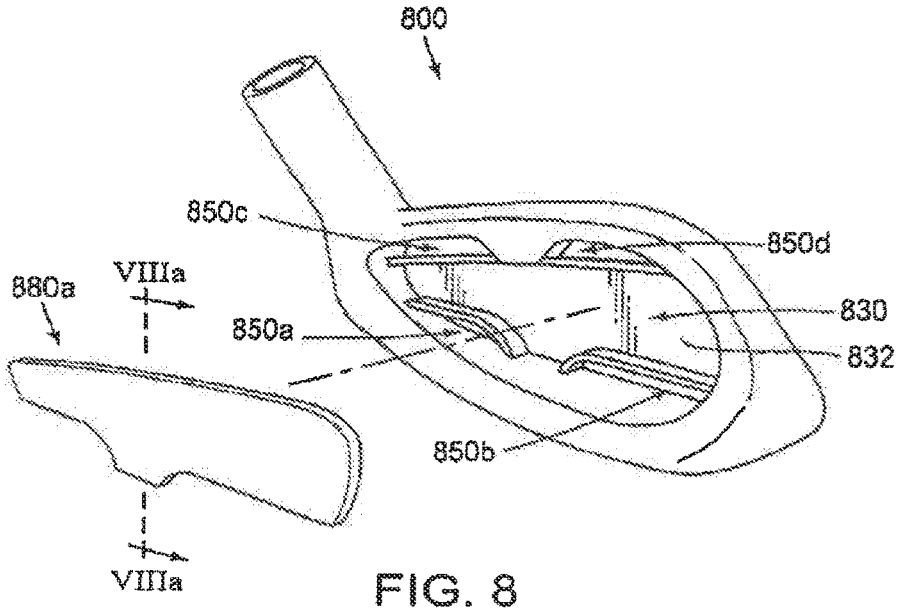
FIG. 8 is an exploded rear perspective view of an exemplary golf club head in accordance with one or more aspects of the present invention.

Referring to FIG. 8, a golf club head 800, according to one or more aspects of the present invention, may comprise a main cavity 830 having at least one auxiliary cavity, e.g., auxiliary cavities 850*a-d*. To improve the dynamic-excitation response of the head at ball impact, at least one vibration-attenuating feature may be disposed in at least one of the main cavity and the auxiliary cavities. For example, the vibration-attenuating feature may be a constrained-layer damper 880*a* that conforms to the shape of the main cavity 830. Examples of constrained-layer dampers are described in U.S. Pat. No. 5,316,298, which is hereby incorporated by reference.

Figure 8A:
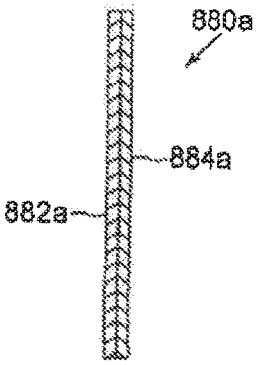
FIG. 8*a* is a cross-sectional view of a vibration-attenuating feature taken along the lines VIIIa-VIIIa of FIG. 8.

The constrained-layer damper 880*a* is provided to improve the dynamic-excitation response of a golf club head at ball impact. Referring to FIG. 8*a*, damper 880*a* may include at least one constraining member 882*a* and a visco-elastic layer 884*a*. The layer 884*a* may comprise a visco-elastic stratum having, e.g., 3M™ VHB™ Adhesive Transfer Tape 9469. The damper 880*a* may be attached to the base surface 832 (FIG. 8) via the adhesive surface of the visco-elastic layer 884*a*.

Figure 8C:
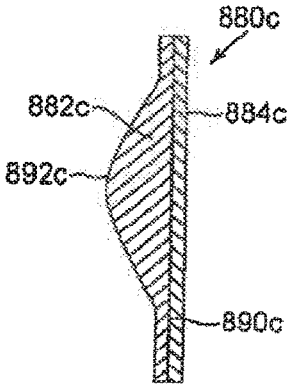
FIGS. 8*b* and 8*c* are cross-sectional views of exemplary vibration-attenuating features of an exemplary golf club head in accordance with one or more aspects of the present invention.
Figure 8B:
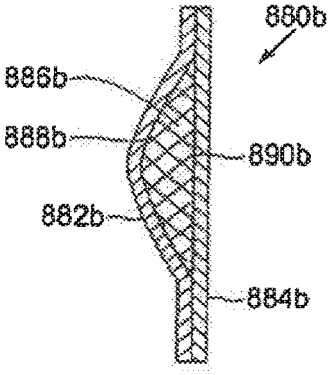

Referring to FIGS. 8*b* and 8*c*, constrained-layer dampers having a three-dimensional topography are illustrated. As shown in FIG. 8*b*, a damper 880*b* may comprise a non-planar constraining member 882*b*, a variable-thickness intermediate layer 886*b*, and a visco-elastic layer 884*b*. The intermediate layer 886*b* may include a non-planar surface 888*b*, complementing the corresponding mating surface of the constraining member, and an opposing substantially flat surface 890*b*. The intermediate layer 886*b* may be co-molded with the constraining member 882*b* or may be attached thereto, e.g., by an adhesive. The intermediate layer 886*b* may be a polymer, e.g., a two-part polyurethane such as MF440 resin activated by DK124HV hardener, or any other suitable material. The visco-elastic layer 884*b* may comprise, e.g., 3M™ VHB™ Adhesive Transfer Tape 9469.

In another example, a constrained-layer damper 880*c*, shown in FIG. 8*c*, may comprise a variable-thickness constraining member 882*c* and a visco-elastic layer 884*c* having adhesive surfaces. The constraining member may include a non-planar exterior surface 892*c* and an opposing substantially flat surface 890*c*. The constraining member 882*c* may be manufactured from a variety of materials including, but not limited to, plastics, metals, and composites.

Figure 9:
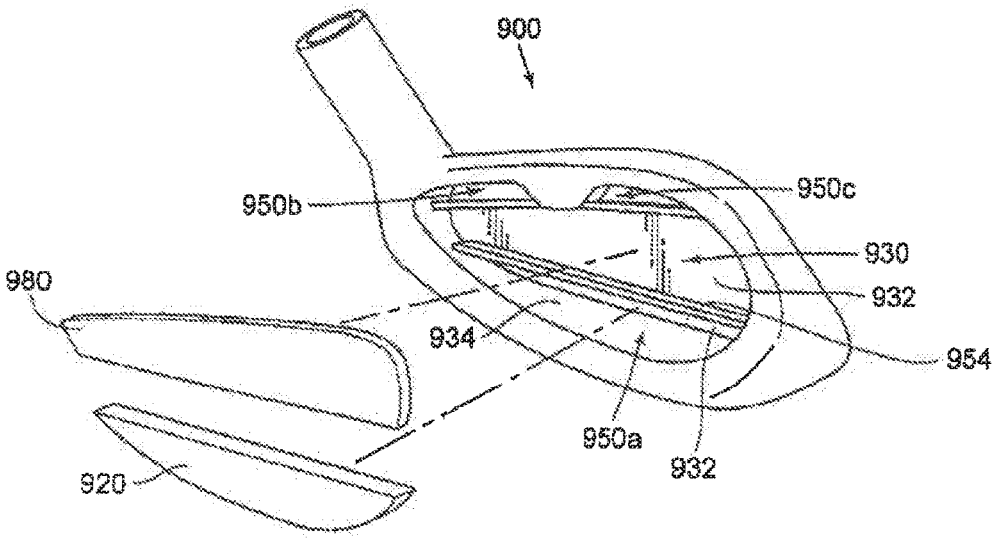
FIG. 9 is an exploded rear perspective view of an exemplary golf club head in accordance with one or more aspects of the present invention.

The club head, according to one or more aspects of the invention, may be provided with additional features to improve the dynamic-excitation response for mishit shots. As shown in FIG. 9, an exemplary golf club head 900 may comprise a main cavity 930 having at least one auxiliary cavity, e.g., auxiliary cavities 950*a-c*. An insert 920, disposed in the auxiliary cavity 950*a*, may abut a base surface 932, a perimeter surface 934, and/or a perimeter wall 954. The insert 920 is provided, at least in part, for abatement of unfavorable vibrations, associated, e.g., with mishit shots. A secondary vibration-attenuating feature, e.g., a constrained-layer damper 980, may also be introduced to further improve the damping properties of the club head 900.

Figure 10A:
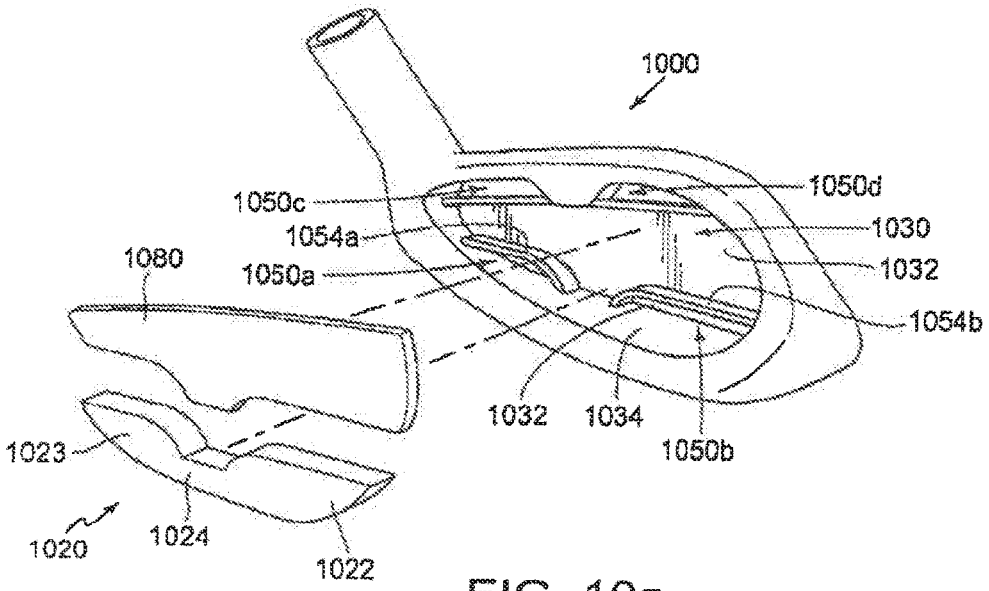
FIG. 10*a* is an exploded rear perspective view of an exemplary golf club head in accordance with one or more aspects of the present invention.
Figure 10B:
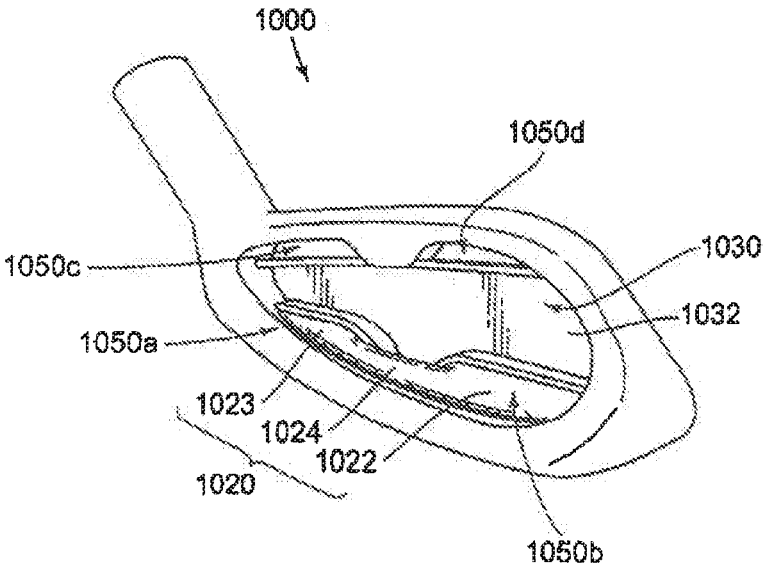
FIG. 10*b* is another rear perspective view of the golf club head of FIG. 10*a*.

In another example, a golf club head 1000, shown in FIGS. 10*a* and 10*b*, may comprise a main cavity 1030 having at least two auxiliary cavities, e.g., auxiliary cavities 1050*a-d*. The club head 1000 may further comprise an insert 1020 having at least two contact elements, e.g., toe element 1022 and heel element 1023, and a bridge member 1024 disposed therebetween. Referring to FIG. 10*b*, the insert 1020 may be at least partially disposed in at least two auxiliary cavities, e.g., the auxiliary cavities 1050*a* and 1050*b*. For example, the heel element 1023 may be positioned in the auxiliary cavity 1050*a* and the toe element 1022 may be positioned in the auxiliary cavity 1050*b*. Preferably, the at least two contact elements abut a base surface 1032 of the main cavity. The bridge member 1024 may be dissociated from the base surface 1032 for the purposes of tuning the dynamic-excitation response of the club head, particularly for mishit shots. A secondary vibration-attenuating feature, e.g., constrained layer damper 1080, may also be provided to further improve the damping properties of the club head.

The insert 1020 may be made from a resilient material having a Shore hardness from about 50 A to about 75 D to provide a soft tactile sensation. In another example, the resilient material may have a Shore hardness from about 60 A to about 80 A. The tactilely perceptible softness of the insert may communicate to the golfer an improvement in the dynamic-response characteristics of the golf club head at ball impact, thus promoting increased player confidence in the equipment. Examples of the resilient materials suitable for fabricating the insert 1020 may include polyurethane, silicone, ABS, Nylon, polycarbonate (PC), polypropylene (PP), polyethylene (PE), thermoplastic rubber (TPR), thermoplastic vulcanizate (TPV), thermoplastic elastomers (TPE), and natural rubber. In another example, the insert 1020 may be made from thermoplastic polyurethane (TPU) having a Shore hardness between about 65 A and about 75 A. The specific gravity of the insert may depend on the material selected and may generally be between about 0.8 and about 2.0. Alternatively, the material selected may be densified by blending the resilient material with a higher-density powdered material, e.g., tungsten, prior to the formation of the insert 1020. The specific gravity of the densified insert may be in a range from about 0.8 to about 15. The insert may therefore be used to alter the weight distribution of the club head.

Referring again to FIGS. 10*a* and 10*b*, the insert 1020 may be bonded to the head 1000 using, e.g., an epoxy-type adhesive. The adhesive may be applied to the base surface 1032, the perimeter surface 1034, and the interior surfaces of two perimeter walls 1054*a* and 1054*b*.

Figure 11:
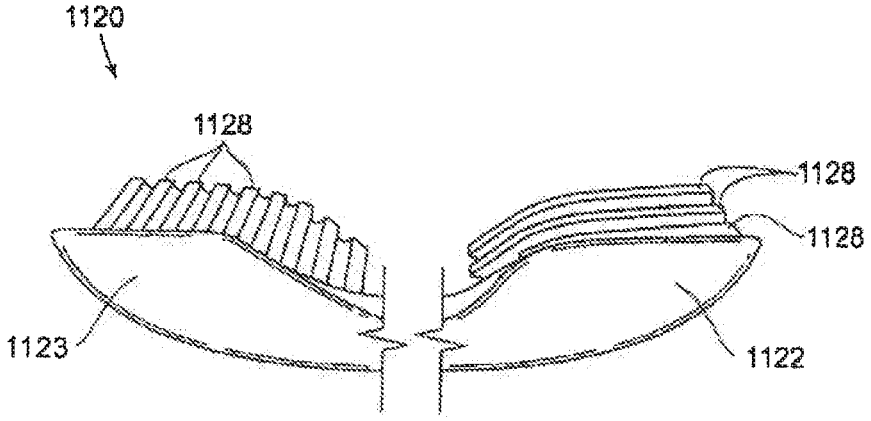
FIG. 11 is a front perspective view of an insert for a golf club head in accordance with one or more aspects of the present invention.

Referring to FIG. 11, an insert, according to one or more aspects of the present invention, e.g., an insert 1120, may comprise one or more ridges 1128 on at least one of the at least two contact elements, e.g., a toe element 1122 and a heel element 1123. The gaps between the ridges may help reduce adhesive "squish-out" when fitting the insert to the club head during assembly. Moreover, the ridges 1128 may promote a stronger bond between the club head and the insert by increasing the area of the bonding interface. As shown in FIG. 11, the ridges 1128 may be disposed on the insert in any desired orientation.

Figure 12:
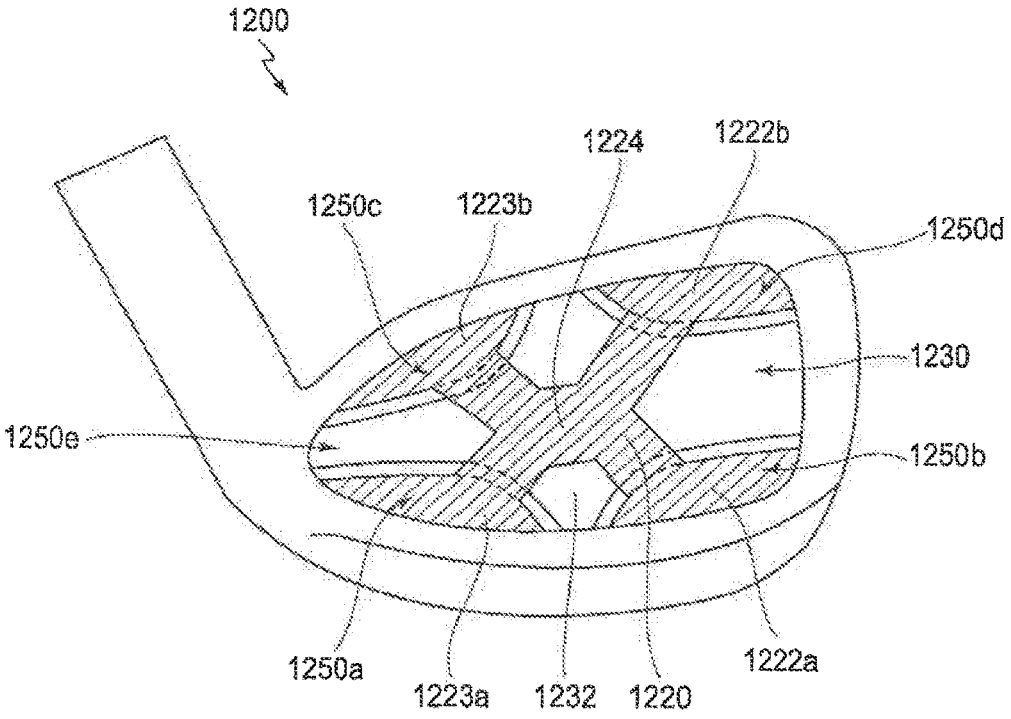
FIG. 12 is a rear elevational view of an exemplary golf club head in accordance with one or more aspects of the present invention.

In another aspect of the present invention, a golf club head 1200, shown in FIG. 12, may comprise a main cavity 1230, having at least three auxiliary cavities, e.g., auxiliary cavities 1250*a-d*, and a central cavity 1250*e*. The auxiliary cavities 1250*a-d* may serve as examples of first through fourth cavities or partitions, and the central cavity 1250*e* may serve as an example of a fifth cavity or partition. The club head 1200 may further comprise an insert 1220, having at least three contact elements, e.g., toe elements 1222*a*, 1222*b* and heel elements 1223*a*, 1223*b*, with a bridge member 1224 disposed therebetween. As shown in FIG. 12, the insert 1220, illustrated by hatching, may be at least partially disposed in at least three auxiliary cavities. For example, the heel elements 1223*a* and 1223*b* may be positioned in the auxiliary cavities 1250*a* and 1250*c*, respectively, and the toe elements 1222*a* and 1222*b* may be positioned in the auxiliary cavities 1250*b* and 1250*d*, respectively. Preferably, the at least three contact elements are in contact with a base surface 1232 of the main cavity. As shown in FIG. 12, the heel elements 1223*a*, 1223*b* and the toe elements 1222*a*, 1222*b* of the insert 1220 may cover, or span, the entire base surface 1232 of the auxiliary cavities 1250*a-d*. The bridge member 1224 may be dissociated, or separate, from the base surface 1232 for the purposes of tuning the dynamic-excitation response of the club head, particularly on mishit shots.

Figure 13:
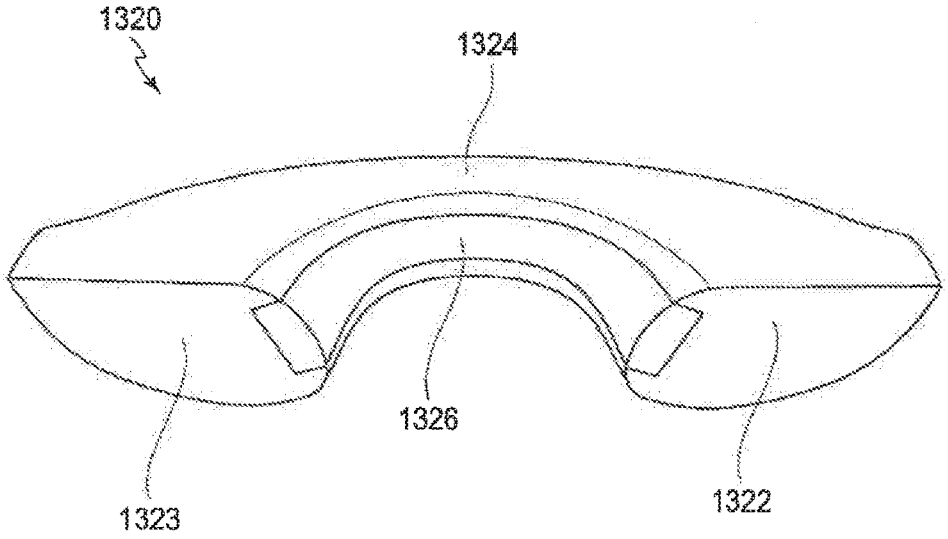
FIG. 13 is a front perspective view of an insert for a golf club head in accordance with one or more aspects of the present invention.
Figure 14:
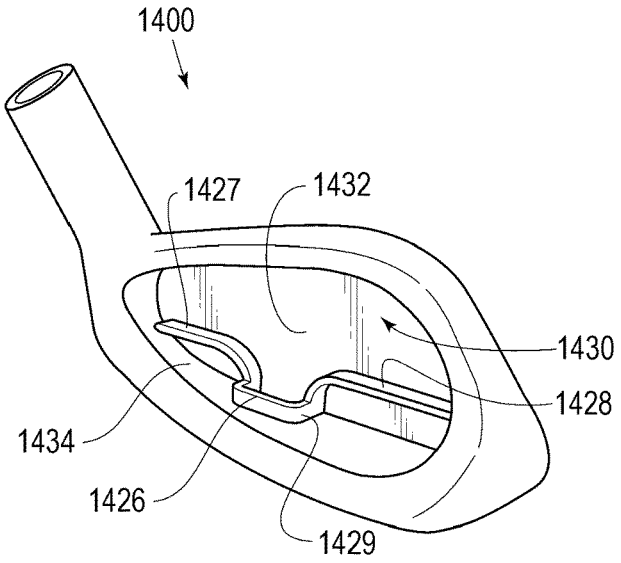
FIG. 14 is a rear perspective view of an exemplary golf club head in accordance with one or more aspects of the present invention.
Figure 15:
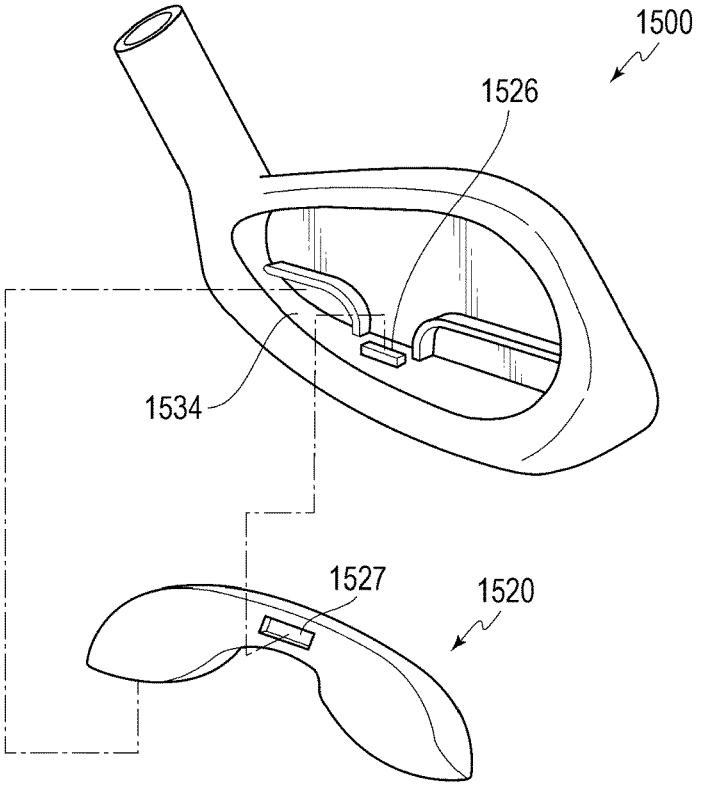
FIG. 15 is an exploded rear perspective view of an exemplary golf club head in accordance with one or more aspects of the present invention.

According to the USGA Rules, all parts of a golf club head must be fixed. In other words, no part of a golf club head may exhibit movement relative to any other part thereof when subject to an external force. Absent additional underpinnings, the bridge members of the exemplary inserts, described above with reference to FIGS. 10*a*-12, may deflect when subjected to external forces. For example, referring to FIG. 10*b*, the bridge member 1024 may deflect toward the base surface 1032 when a force is applied to the bridge member in the direction of the base surface. As shown in FIGS. 13-15, auxiliary elements may be incorporated into the club head and/or the insert to substantially inhibit movement of the insert relative the club head.

With reference to FIG. 13, an insert 1320, according to one or more aspects of the present invention, may comprise at least two contact elements, e.g., heel element 1322 and toe element 1323, with a bridge member 1324 disposed therebetween. The insert 1320 may further comprise a stiffening member 1326 extending, e.g., from the heel element 1322 to the toe element 1323 along the bridge member 1324. The stiffening member 1326 may be flush with the insert 1320, at least in part, recessed, at least in part, and/or salient, at least in part. Regardless of the configuration, the stiffening member 1326 is provided to prevent the insert 1320 from deflecting, e.g., more than about 1 mm (0.040 in.) relative to the club head with the application of about 45 N (10 lb) of force. The applied force should generally correspond to the typical force delivered by the thumb of a golfer or a golf official who may wish to test the head for conformance with the applicable rules of golf.

Referring again to FIG. 13, the stiffening member 1326 may be formed from a polymeric material, such as ABS, Nylon, PVC, Polystyrene, Polypropylene, High Density Polyethylene, glass- or carbon-fiber-reinforced plastic, or the like. Metallic materials, e.g., aluminum, steel, magnesium, titanium, or the like, may also be used. In general, the material selected should provide sufficient stiffness to realize the deflection criteria discussed above. In one example, the stiffening member 1326 may be attached to the insert 1320, e.g., by adhesive bonding or other known methods. Alternatively, the parts of the insert may be integrally co-molded.

In another example, shown in FIG. 14, a golf club head 1400, according to one or more aspects of the present invention, may comprise a main cavity 1430, having a perimeter surface 1434 and a stiffening member 1426 disposed on the perimeter surface. The stiffening member 1426 may include a first stiffening member portion 1427, a second stiffening member portion 1428, and a third stiffening member portion 1429 bridging a portion of the base surface 1432 spacing the first stiffening member portion from the second stiffening member portion. As further shown in FIG. 14, the stiffening member 1426 may have an arch-like configuration for buttressing the bridge member of any exemplary insert described with reference to FIGS. 10*a*, 10*b*, 11, 12, and 13 above. Such a construction may sufficiently stiffen such an insert to conform to the rules of golf. The stiffening member may be formed separately from the head 1400 and may be attached thereto, e.g., by adhesive bonding, welding, or other joining techniques. Alternatively, the stiffening member may be cast integrally with the head. Adhesives may be employed at the interface between the insert and the stiffening member 1426 to further stabilize and anchor the insert to the club head.

With reference to FIG. 15, a golf club head 1500, according to one or more aspects of the present invention, may comprise an insert 1520 and a perimeter surface 1534 having a stiffening member 1526. The stiffening member 1526 may protrude from the perimeter surface 1534 for engagement with a complementary opening 1527 formed in the insert 1520. Engagement of the insert 1520 with the stiffening member 1526 substantially vitiates the deflection of the insert relative to the club head. As shown in FIG. 15, the stiffening member 1526 and the complimentary opening 1527 may, for example, comprise generally rectangular shapes. As described above, adhesives may be employed at the interface between the insert 1520 and the stiffening member 1526 to further stabilize and anchor the insert to the club head.

It may also be desirable to enhance the cosmetic appeal of the club head, according to one or more aspects of the present invention, with the use of organic surface coatings, e.g., paint or the like. However, the application of such coatings to the club head may lead to a weak bond between the club head and any supplementary vibration-attenuation components, such as those described above. Thus, specific preparation of the club head surface is necessary for the durability of any adhesive bond between the club head and its bonded components. Such surface preparation may include cleaning the head with solvents or other chemicals and subsequently treating any surfaces that will have an adhesive and/or coating applied thereto with an abrasive medium. Organic surface coatings should be applied to the head prior to the attachment of any supplementary components to avoid staining the supplementary components with the coating.

Figure 16:
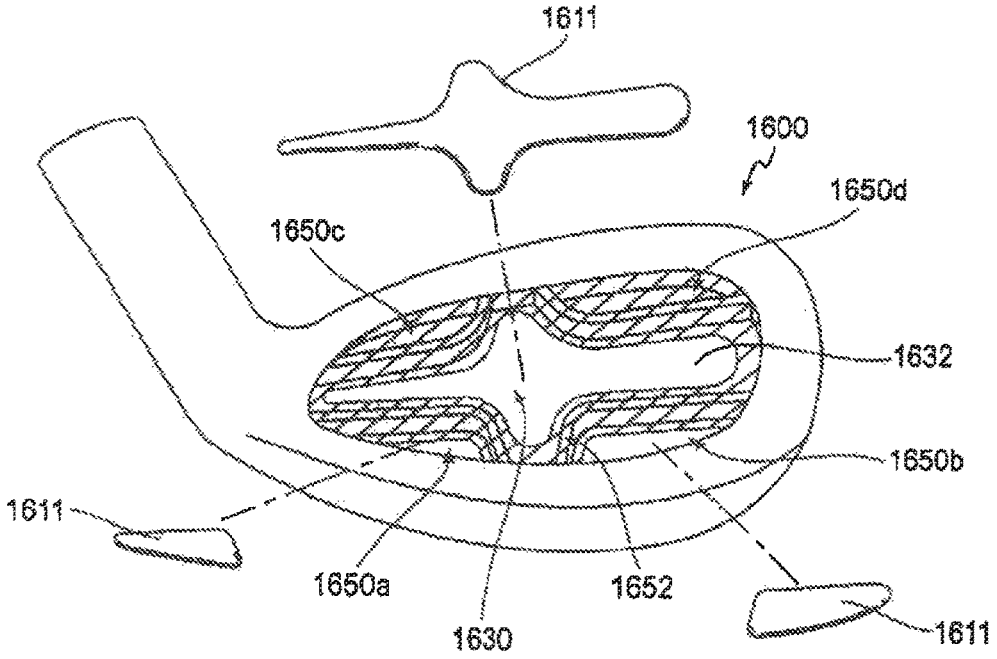
FIG. 16 is an exploded rear elevational view of an exemplary golf club head in accordance with one or more aspects of the present invention.

Referring to FIG. 16, a golf club head 1600, according to one or more aspects of the present invention, may comprise a main cavity 1630 having a base surface 1632 and at least one auxiliary cavity, e.g., auxiliary cavities 1650*a-d*. Subsequent to any desired surface preparation step, such as the exemplary steps described above, one or more sections of a masking material 1611 may be applied to at least a portion of one or more regions of the main cavity 1630, where at least one supplementary component will subsequently be adhesively bonded. The masking material 1611 may be configured to cover at least about 50% of one or more regions of the base surface 1632 where at least one supplementary component will be attached. In other examples, the masking material may cover at least about 60% of one or more of the above-mentioned regions or at least about 80% of the above-mentioned regions. The organic surface coating 1652 is then applied to the portion of the club head that is devoid of the masking material 1611. Following the application of the organic coating, the masking material is removed. The supplementary components, such as inserts and/or constrained-layer dampers, are then coupled to the desired regions of the base surface 1632 having areas devoid of the organic coating, thus promoting a durable bond between the club head and any such supplementary component.

In the foregoing specification, the invention has been described with reference to specific exemplary aspects thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

The invention claimed is:

1. An iron-type golf club head comprising:
- a striking face;
- a base surface opposite the striking face;
- a perimeter weighting element surrounding the base surface and including a top portion, a sole portion, a heel portion, and a toe portion;
- a central cavity at least partially delimited by the base surface and the perimeter weighting element;
- a first auxiliary cavity located in the central cavity and delimited by the perimeter weighting element, a first perimeter wall, and the base surface;
- a second auxiliary cavity located in the central cavity and delimited by the perimeter weighting element, a second perimeter wall, and the base surface;
- a stiffening member protruding from the perimeter weighting element; and
- an insert extending between the first auxiliary cavity and the second auxiliary cavity and comprising an opening complementary to, and engaging with, the stiffening member.

2. The iron-type golf club head of claim 1, wherein the insert and the stiffening member are secured with adhesive.

3. The iron-type golf club head of claim 1, wherein the insert comprises a durometer hardness between about 60 Shore A and about 80 Shore A.

4. The iron-type golf club head of claim 1, wherein the insert comprises a specific gravity between about 0.8 and about 2.0.

5. The iron-type golf club head of claim 1, wherein the insert is recessed inwardly toward the base surface relative to a rear surface of the perimeter weighting element.

6. The iron-type golf club head of claim 1, wherein the insert is adhesively coupled to the base surface within each of the first auxiliary cavity and the second auxiliary cavity.

7. The iron-type golf club head of claim 1, wherein the insert spans at least the distance between the first auxiliary cavity and the second auxiliary cavity in a heel to toe direction.

8. The iron-type golf club of claim 1, wherein the insert and the stiffening member are substantially rectangular in shape.

9. The iron-type golf club of claim 1, wherein the insert does not contact the base surface of the central cavity.

10. The iron-type golf club of claim 1, wherein the first perimeter wall extends between the heel portion and the sole portion of the perimeter weighting element and the second perimeter wall extends between the toe portion and the sole portion of the perimeter weighting element.

11. An iron-type golf club head comprising:
- a striking face;
- a base surface opposite the striking face;
- a perimeter weighting element surrounding the base surface and including a top portion, a sole portion, a heel portion, and a toe portion;
- a central cavity at least partially delimited by the base surface and the perimeter weighting element; and
- a stiffening member located within the central cavity, the stiffening member including:
  - a first stiffening member portion defining a first auxiliary cavity located in the central cavity and delimited by the perimeter weighting element, the stiffening member, and the base surface;
  - a second stiffening member portion defining a second auxiliary cavity located in the central cavity and delimited by the perimeter weighting element, the stiffening member, and the base surface; and
  - a third stiffening member portion generally disassociated from the base surface and extending between the first auxiliary cavity and the second auxiliary cavity, bridging a portion of the base surface spacing both the first auxiliary cavity from the second auxiliary cavity and the first stiffening member portion from the second stiffening member portion, and coupled to and extending along the perimeter weighting element adjacent to the sole portion.

12. The iron-type golf club head of claim 11, wherein the third stiffening member portion is adhesively coupled to the perimeter weighting element.

13. The iron-type golf club head of claim 11, wherein the first auxiliary cavity and the second auxiliary cavity are recessed inwardly toward the base surface relative to a rear surface of the perimeter weighting element.

14. The iron-type golf club head of claim 13, wherein the third stiffening member portion is recessed inwardly toward the base surface relative to the rear surface of the perimeter weighting element.

15. The iron-type golf club head of claim 11, wherein the third stiffening member portion is substantially rectangular.

16. The iron-type golf club head of claim 11, wherein:
- the first auxiliary cavity is proximal the heel portion and the sole portion and distal the top portion and the toe portion; and
- the second auxiliary cavity is proximal the toe portion and the sole portion and distal the top portion and the heel portion.

17. The iron-type golf club head of claim 11, wherein the third stiffening member portion extends along the sole portion of the perimeter weighting element.

* * * * *